US008579388B2

(12) United States Patent
Centazzo et al.

(10) Patent No.: US 8,579,388 B2
(45) Date of Patent: Nov. 12, 2013

(54) MODULAR PIECE OF FURNITURE MADE OF RECYCLABLE MATERIALS

(75) Inventors: Gabriele Centazzo, Pordenone (IT); Massimo Graffeo, Pordenone (IT)

(73) Assignee: Valcucine S.p.A. (IT)

( * ) Notice: Subject to any disclaimer, the term of this patent is extended or adjusted under 35 U.S.C. 154(b) by 0 days.

(21) Appl. No.: 13/402,513

(22) Filed: Feb. 22, 2012

(65) Prior Publication Data

US 2012/0146471 A1 Jun. 14, 2012

Related U.S. Application Data

(63) Continuation of application No. PCT/EP2009/006117, filed on Aug. 24, 2009.

(51) Int. Cl.
*A47B 87/00* (2006.01)

(52) U.S. Cl.
USPC ..... 312/108; 312/111; 312/117; 312/140; 312/263; 312/265.2

(58) Field of Classification Search
USPC ..... 312/107, 108, 111, 114, 117, 140, 312/257.1, 263, 265.1, 265.2, 265.5
See application file for complete search history.

(56) References Cited

U.S. PATENT DOCUMENTS

| | | | | | |
|---|---|---|---|---|---|
| 2,196,399 | A | * | 4/1940 | Rubel | 220/4.01 |
| 3,224,823 | A | * | 12/1965 | Schulze | 312/108 |
| 3,329,473 | A | * | 7/1967 | Dickson | 312/108 |
| 3,784,273 | A | * | 1/1974 | Nikolai | 312/265.3 |
| 3,879,096 | A | * | 4/1975 | Blodee | 312/265 |
| 4,154,493 | A | * | 5/1979 | Prater | 312/265.5 |
| 4,281,883 | A | * | 8/1981 | Zacky | 312/140 |
| 4,378,137 | A | * | 3/1983 | Gibson et al. | 312/265.3 |
| 4,691,970 | A | * | 9/1987 | Neri | 312/265.5 |
| 4,974,386 | A | * | 12/1990 | Eriksson et al. | 52/282.3 |
| 4,997,240 | A | * | 3/1991 | Schmalzl et al. | 312/265.4 |

(Continued)

FOREIGN PATENT DOCUMENTS

| | | |
|---|---|---|
| EP | 0142659 A2 | 5/1985 |
| GB | 1099582 A | 1/1968 |

OTHER PUBLICATIONS

International Preliminary Report on Patentability; Application No. PCT/EP2009/006117; Issued: Dec. 20, 2011; 6 pages.

(Continued)

*Primary Examiner* — Darnell Jayne
*Assistant Examiner* — Daniel Rohrhoff
(74) *Attorney, Agent, or Firm* — St. Onge Steward Johnston & Reens LLC

(57) ABSTRACT

Furniture with compartments housing drawers and/or baskets and/or wing doors and consisting of a lower frame, rear frame, upper frame, and lateral sides, characterised in that said lower frame consists of a lower front and lower rear section connected using orthogonally placed lower side sections, said rear frame consists of an upper rear and a lower rear crosspiece connected using orthogonally placed side stanchions, said upper frame consists of an upper front crosspiece on which upper side crosspieces are fixed, said lower side sections, said side stanchions, and said upper side crosspieces including seats intended to house by means of insertion said lateral sides, said lateral sides being fixed on the lower side using fixing means inserted in holes on the lower side and using blocking means, said lateral sides being fixed on the upper part using at least one fixing means inserted in an upper hole and blocking means.

19 Claims, 6 Drawing Sheets

(56) References Cited

U.S. PATENT DOCUMENTS

| | | | | |
|---|---|---|---|---|
| 5,632,542 | A * | 5/1997 | Krivec | 312/334.7 |
| 5,806,946 | A * | 9/1998 | Benner et al. | 312/265.3 |
| 6,788,997 | B1 * | 9/2004 | Frederick | 700/236 |
| 6,808,074 | B1 * | 10/2004 | Schwartz | 206/577 |
| 6,908,252 | B1 * | 6/2005 | Rubano | 403/231 |
| 2002/0017839 | A1 * | 2/2002 | Wei | 312/265.1 |
| 2007/0007865 | A1 * | 1/2007 | Kang | 312/114 |
| 2007/0290586 | A1 * | 12/2007 | Rosete et al. | 312/236 |
| 2010/0202852 | A1 * | 8/2010 | Krause et al. | 411/272 |

OTHER PUBLICATIONS

International Search Report; Application No. PCT/EP2009/006117; Issued: Aug. 19, 2010; Mailing Date: Aug. 26, 2010; 2 pages.

* cited by examiner

MODULAR PIECE OF FURNITURE MADE OF RECYCLABLE MATERIALS

CROSS-REFERENCE TO RELATED APPLICATIONS

The present Application is a continuation of pending International Patent Application PCT/EP2009/006117 filed on Aug. 24, 2009 which designates the United States, and the content of which is incorporated herein by reference.

FIELD OF THE INVENTION

The present invention relates to a modular piece of furniture completely consisting of recyclable materials.

BACKGROUND OF THE INVENTION

In the field of the production of pieces of furniture, be they already mounted or be they of the type to be mounted at the moment of the installation, usually hardwood panels or chipboard or MDF panels are used which are fixed to a supporting frame which may be then coated outside with finishes of different materials such as noble wood veneers, sliced wood, paper, PVC, multi-layer plastic materials, laminated materials, polymeric laminated materials, aluminium. The finishes are fixed to the panel by means of glues and/or resins and the assembly occurs by means of screws and glues and/or resins.

GB1099582A discloses an article of furniture including, in addition to the collapsible carcase, a drawer or drawers, wherein there is provided, for the one or each drawer, a horizontal rectangular drawer support frame having drawer guiding runners, said frame being detachably engaged with and connecting side wall panels of the carcase at a position intermediately in the height of said carcase.

Problems of the Prior Art

The pieces of furniture produced according to the prior art have the following disadvantages:

- the fixing of the finishes of the panels forming the piece of furniture by means of the use of glues and/or resins involves the need for specific equipment which must be programmed from time to time depending on the required production;
- in the case of the fixing of materials such as aluminium or composite materials, the glues can, over time, cause partial or complete detachments of the finishes with the consequent need to completely replace the panel forming the piece of furniture;
- the panels manufactured in this way must be prearranged in advance with respect to the preparation of the piece of furniture on which they must be fixed, consequently needing to provide groups of complete panels to be kept ready for the following needs; in the case in which the piece of furniture is supplied in an already mounted condition there will be encumbrance problems of the piece of furniture itself for its storing, its transportation and its positioning in the place where it must be installed;
- in the case in which the piece of furniture is sent in a dismounted condition no encumbrance problems occur but the assembly of the different components is complex and it can hardly be performed by the end user also due to the need to use glues and/or resins to ensure the fixing of the different components;

- both in the case in which the piece of furniture is already mounted and in the case in which it is mounted at the moment of the installation the use of glues and/or resins for the assembly makes difficult the dismounting operation for the disposal of the materials;
- both in the case in which the piece of furniture is already mounted and in the case in which it is mounted at the moment of installation the use of panels made of different materials, coated by means of glues and/or resins makes difficult if not impossible to completely recycle said materials once the life cycle of the piece of furniture itself has ended;
- the use of common panels consisting of wood and/or wood substitutes, e.g. of chipboard, involves the deterioration of the material particularly due to humidity and wetting; moreover the chipboard has a considerable weight. In any case these materials involve the need to use great thicknesses.

SUMMARY OF THE INVENTION

The aim of this invention is to supply a piece of furniture made of recyclable materials which does not require the use of glues and/or resins for the assembly, which is easy to be assembled and which successively is also easy to be disassembled in order to facilitate the operations for the following disposal of the materials it consists of.

A further aim is to supply a greater structural strength to the piece of furniture with a limited thickness of the panels and with a maximum resistance to deterioration, both due to atmospheric agents or to humidity and to acids and other aggressive agents.

Concept of the Invention

The aim is reached with the characteristics of the main claim while the dependent claims represent advantageous solutions.

Advantageous effects of the Invention

With the characteristics of this invention one obtains:

- advantages from the point of view of the easy assembly and disassembly of the same at the end of the cycle of use, allowing the installation by the end user;
- advantages due to recyclableness;
- an assembly which does not require the use of glues and/or resins, with additional advantages from the environmental point of view, allowing the absence of materials which are difficult to be disposed;
- a maximum resistance to the deterioration agents known in kitchen as water and acids and any other agent which can interact with the surfaces of the pieces of furniture; and,
- a greater structural resistance and a greater cohesion of the mechanical fixing with stability and long-time duration without the risk of partial detachments among the junctions.

Description of the preferred Embodiment

The invention will be now described in a preferred embodiment to be intended not as limitative but only to better understand the invention, wherein:

DETAILED DESCRIPTION OF THE INVENTION

Figure 1:
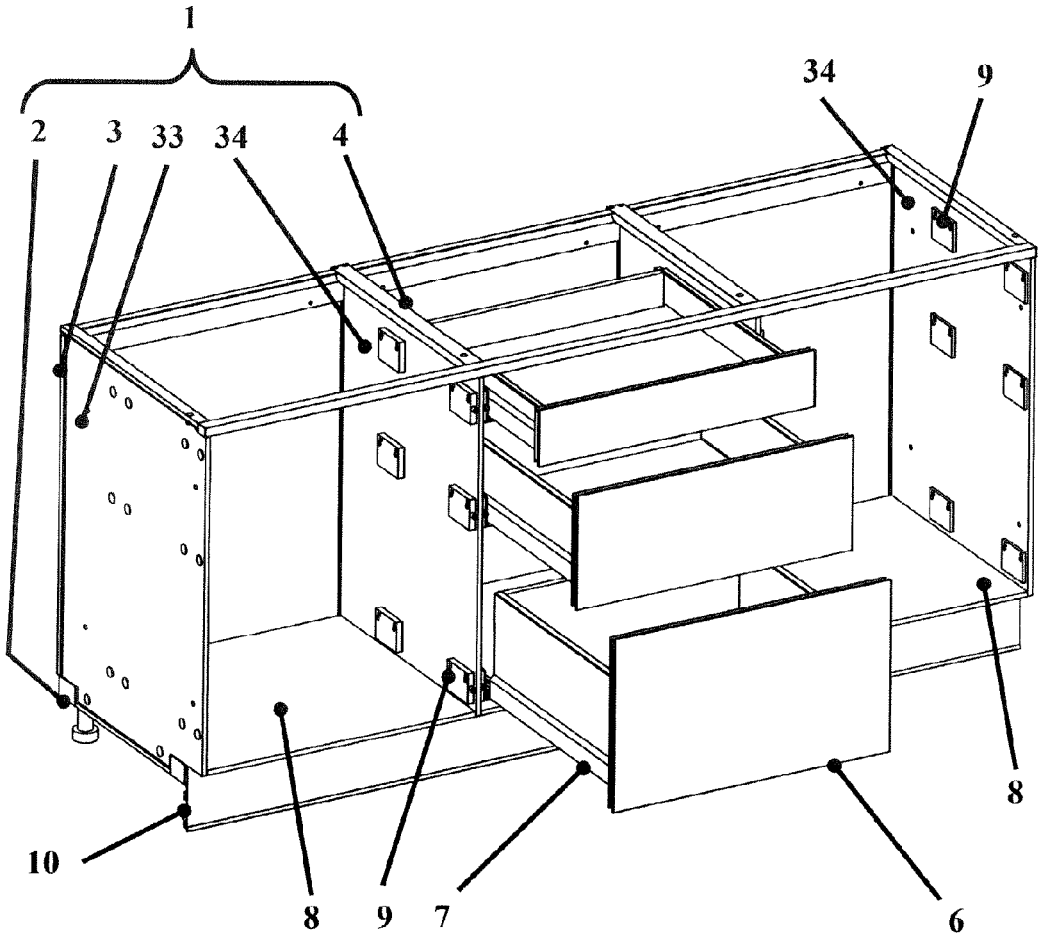
FIG. 1 represents an example of the piece of furniture in a three-dimensional view

In FIG. 1 one can identify the lower frame (2), the rear frame (3), the upper frame (4), the lateral side (33), the central side (34), the accessories (6), the accessories fixing devices (7), the bottom (8), the spacer (9), and the front cover (10).

Figure 2:
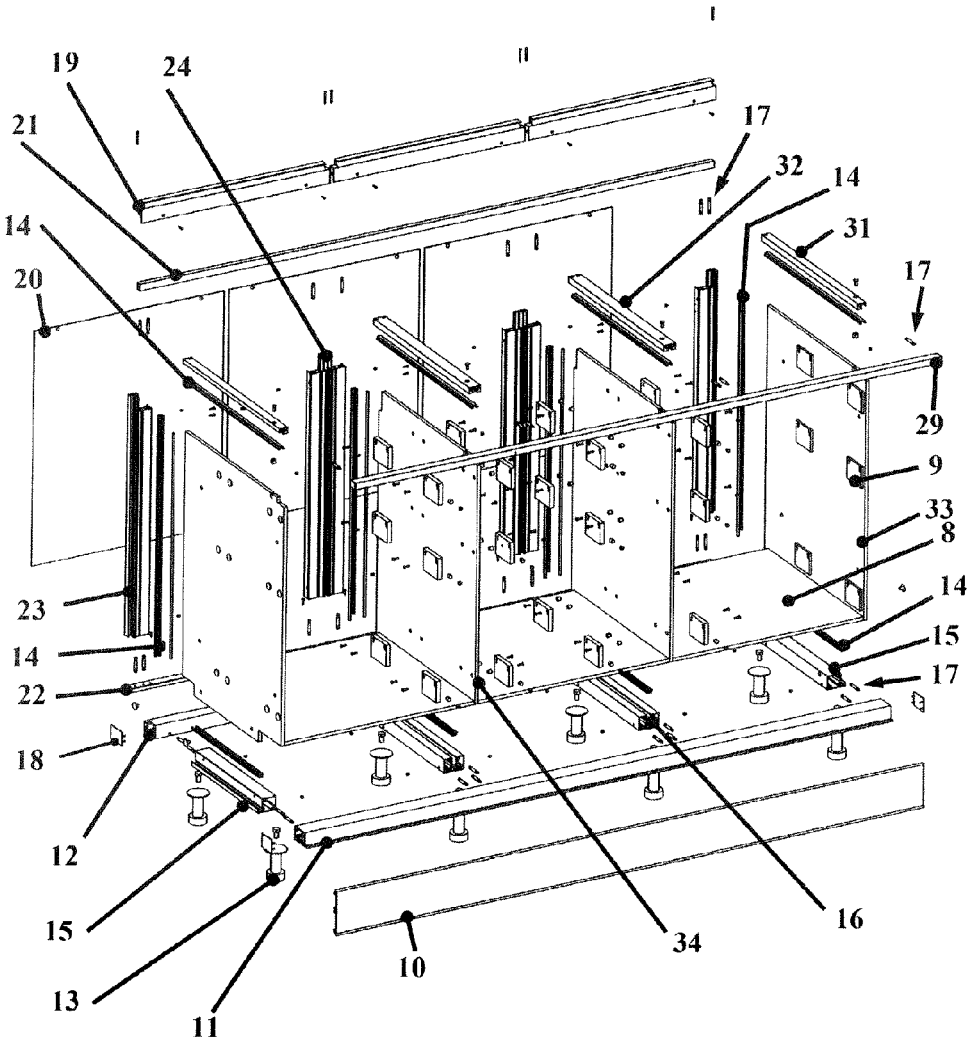
FIG. 2 represents an exploded view of the piece of furniture

In FIG. 2 one can also identify, besides some of the previously described components, the lower front section (11), the lower rear section (12), the foot (13), the lower gasket (14), the lower side section (15), the lower central section (16), the tie-rod (17), the lower frame cover (18), the removable crosspiece (19), the back (20), the upper rear crosspiece (21), the lower rear crosspiece (22), the side stanchion (23), the central stanchion (24), the upper front crosspiece (29), the upper side crosspiece (31), the upper central crosspiece (32).

Figure 3:
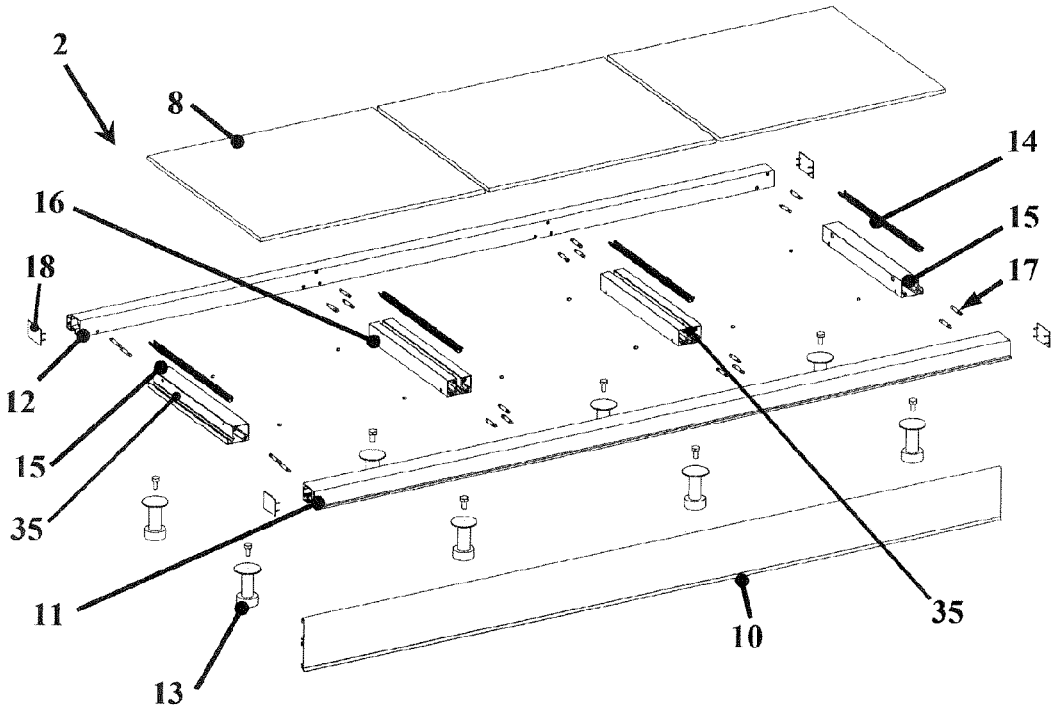
FIG. 3 represents an exploded view of the lower frame
Figure 4:
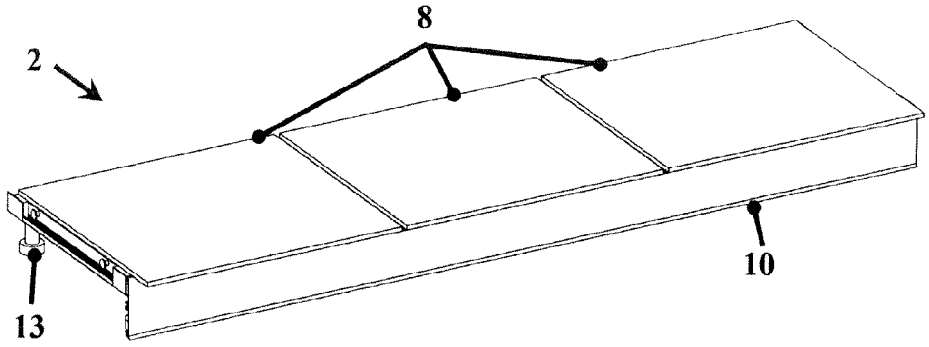
FIG. 4 represents a three-dimensional view of the lower frame

In FIGS. 3 and 4 one can see the lower frame (2) and the seats (35) for the insertion of the sides can be identified as well.

Figure 5:
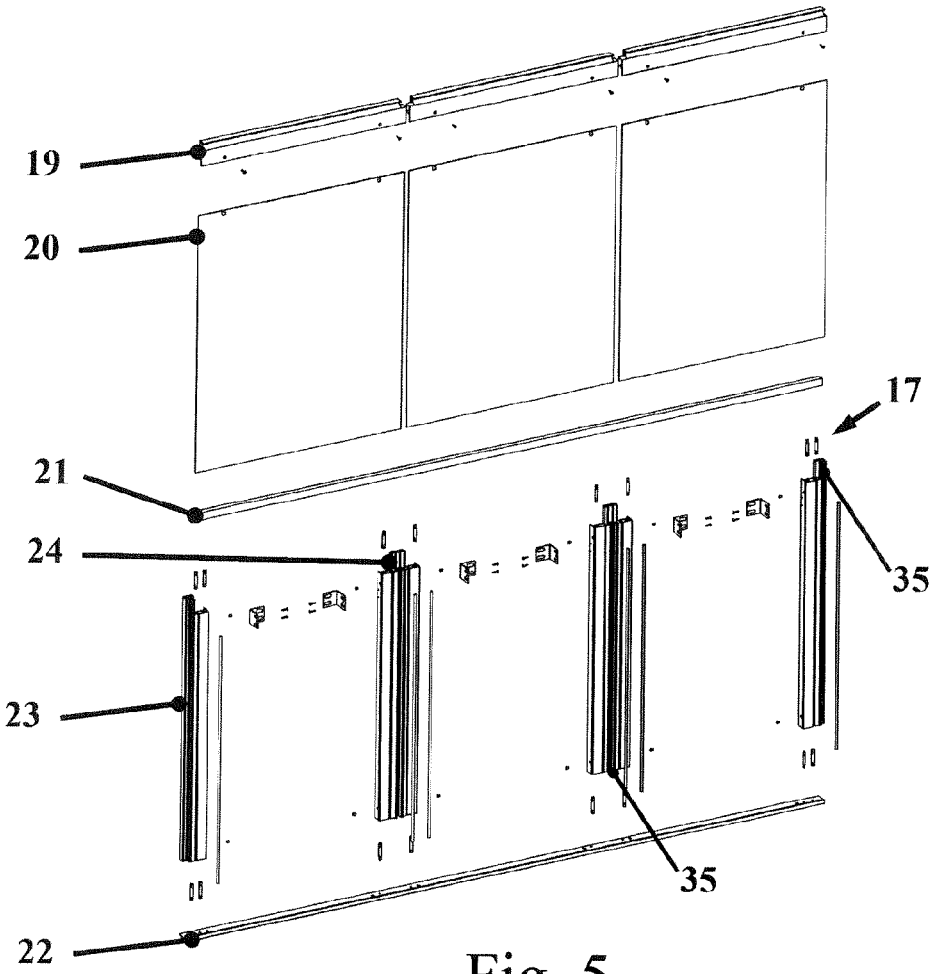
FIG. 5 represents an exploded view of the rear frame
Figure 6:
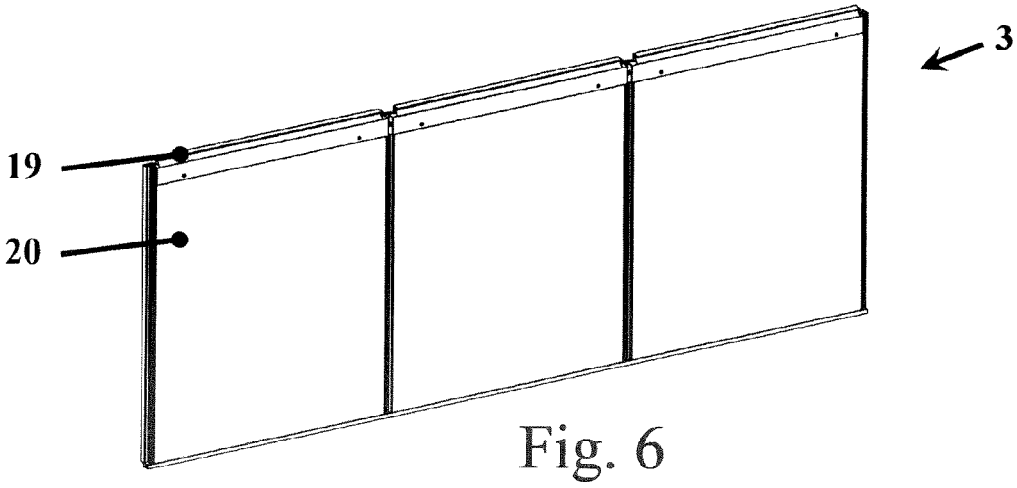
FIG. 6 represents a three-dimensional view of the rear frame

In FIGS. 5 and 6 the rear frame (3) can be seen.

Figure 7:
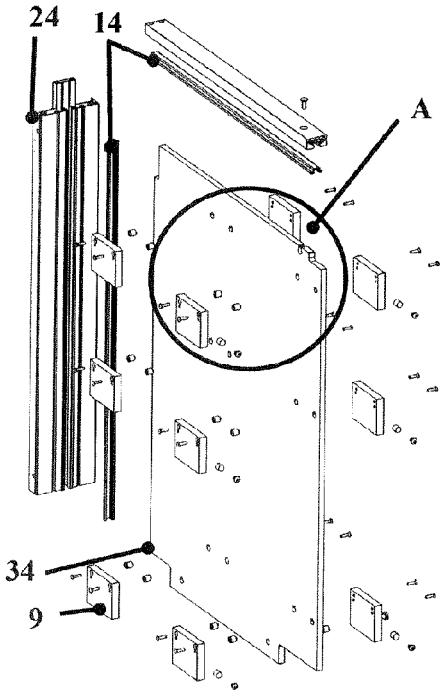
FIG. 7 represents an exploded three-dimensional view of the central side

In FIG. 7 one can observe the structure of the central side (34).

Figure 8:
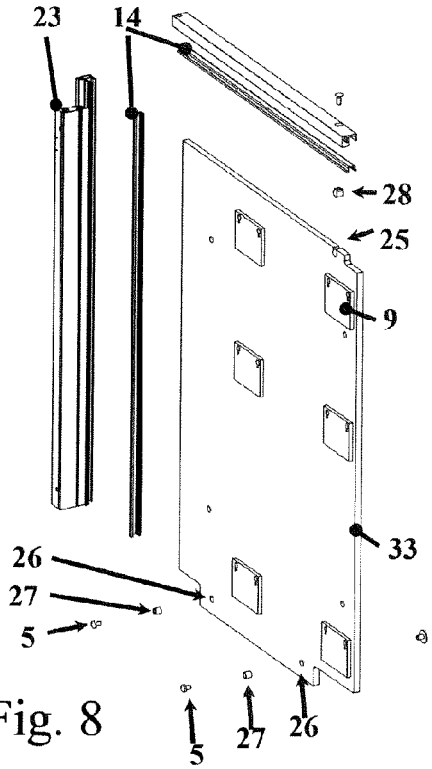
FIG. 8 represents an exploded three-dimensional view of the lateral side

In FIG. 8 one can observe the structure of the lateral side (33) in which, besides some of the previously described components, it is also possible to identify the screw (5), the hole (26), the bushing (27), the upper hole (25), the upper bushing (28).

Figure 9:
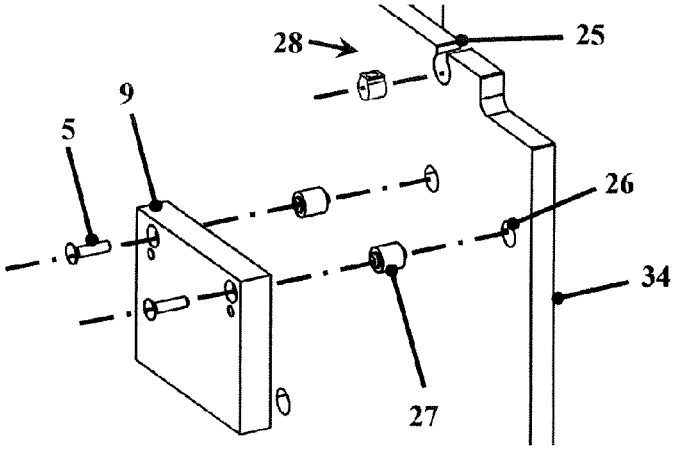
FIG. 9 represents an enlarged view of the detail indicated with A in FIG. 7

In FIG. 9 one can observe more in detail the fixing of the spacers (9) and of the upper bushing (28).

Figure 10:
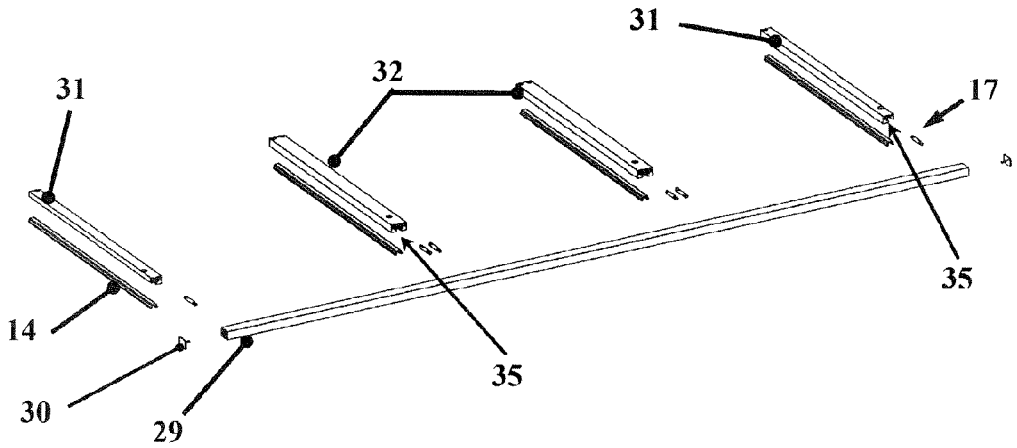
FIG. 10 represents an exploded three-dimensional view of the upper frame
Figure 11:
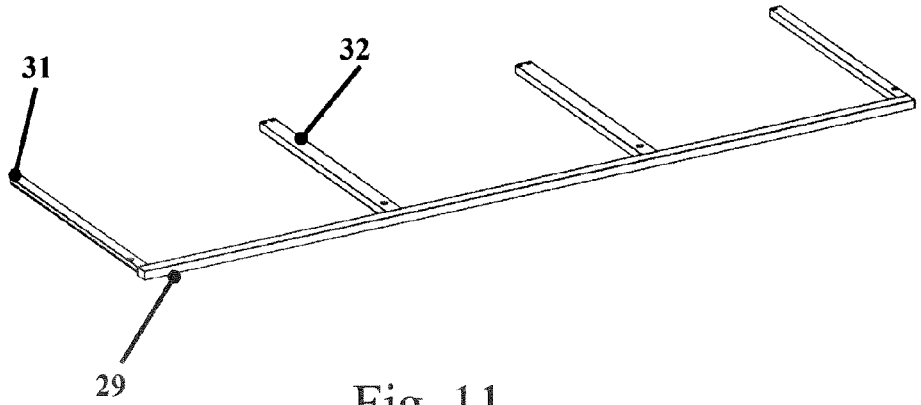
FIG. 11 represents a three-dimensional view of the upper frame

In FIGS. 10 and 11 one can see the upper frame (4).

Detailed Description of the Piece of Furniture

The modular piece of furniture (1) (FIGS. 1-2) essentially consists of:

- a lower frame (2) with the relative front cover (10) and the bottom (8)
- a rear frame (3)
- an upper frame (4)
- a lateral side (33)
- a central side (34)

The accessories (6), such as drawers and/or extractable baskets, shelves, doors and other components whose possible installation will be evident to those skilled in the art, are mounted by means of the fixing devices (7) applied by means of the spacer (9), whose function will be explained in the following of the present description.

Said lower frame (2) (FIGS. 3-4) consists of two sections placed parallel to each other, one of which is located on the front side and is named lower front section (11) and the other one is located on the rear side and is named lower rear section (12). Said front and rear sections are joined together by means of at least two lower side sections (15) and possible lower central sections (16) which may be present or not depending on the overall width of the piece of furniture. The assembly of said components occurs by means of tie-rods (17) which allow to obtain a simple, fast and reliable fixing system which does not require the use of further retaining means, such as for example glues and/or resins, and allows the assembly by the end user directly in the installation place also allowing to send said lower frame in a completely dismounted condition, with a resulting lower encumbrance which is particularly advantageous both in the storage phase of the same in stock, and during the transportation phase of the same.

On said lower front section (11) and lower rear section (12) the feet (13) are fixed by means of hexagonal-head screws, whose head is inserted on a special seat obtained by milling a lower portion of said sections, in such a way that the screw is blocked when the relative foot (13) is screwed. It will be evident to those skilled in the art that other methods for fixing said feet are possible too.

Once assembled, said lower frame (2) constitutes the base for fixing the sides which are inserted inside proper seats (35) located on the lower side sections (15) and lower central sections (16), after the application of a gasket (14) having both a sealing function to prevent dirt from penetrating into said seat, and a protection function of the side which in a preferred embodiment of this invention, is made of glass, and a clamping function of the side itself. The blocking of the sides, as it will be better disclosed in the following of the present description, occurs by means of screws, bushings and sleeves.

The bottom (8) of said lower frame (2) consists of panels, which in a preferred embodiment of this invention, are made of glass. Each of the panels forming said bottom conveniently rests on said sections without being fixed to them, in order to facilitate the cleaning operations of the underlying space by simply removing said panels. On the front side a front cover (10) covers the underside of said lower frame (2).

Said rear frame (3) (FIGS. 5-6) consists of two crosspieces placed parallel to each other, one of which is located below and is named lower rear crosspiece (22) and the other one is located above and is named upper rear crosspiece (21). Said upper and lower crosspieces are joined together by means of at least two side stanchions (23) and possible central stanchions (24) which may be present or not depending on the overall width of the piece of furniture. The assembly of said components occurs by means of tie-rods (17) which allow to obtain a simple, fast and reliable fixing system which does not require the use of further retaining means, such as for example glues and/or resins, and allows the assembly by the end user directly in the installation place also allowing to send said rear frame in a completely dismounted condition, with a resulting lower encumbrance which is particularly advantageous both in the storage phase of the same in stock, and during the transportation phase of the same.

On the lower rear crosspiece (22) as well as on the lower rear (22) and upper rear (21) crosspieces a seat has been created for the insertion of the back (20) which can be made of glass or of a laminated material or of any other material commonly used in the sector, preferably an easily recyclable material. Said back is advantageously inserted from above into said seats, therefore being also successively easy to be extracted both by necessity and in the case in which the piece of furniture as a whole must be dismounted. The blocking in position of said back advantageously occurs by means of the removable crosspiece (19) which is advantageously easy to be dismounted to allow the following passage of the feeding lines such as electrical cables and/or pipes for gas and/or for water in the case in which said piece of furniture (1) is used as a component of a kitchen.

Moreover, on said side (23) and central (24) stanchions a seat (35) has been created for the insertion of a gasket (14), in which the glass side will be inserted to be fixed on the back and to be kept in position.

Said upper frame (3), as indicated in FIGS. 10-11, consists of an upper front crosspiece (29) to which two upper side crosspieces (31) are joined and to which possible upper central crosspieces (32) are joined, which may be present or not depending on the overall width of the piece of furniture. The assembly of said components occurs by means of tie-rods (17) which allow to obtain a simple, fast and reliable fixing system which does not require the use of further retaining means, such as for example glues and/or resins, and allows the assembly by the end user directly in the installation place also allowing to send said frame in a completely dismounted condition, with a resulting lower encumbrance which is particularly advantageous both in the storage phase of the same in stock, and during the transportation phase of the same.

On said upper side crosspieces (31) and possible upper central crosspieces (32), a seat (35) is present for the insertion of a gasket (14), in which the glass side will be inserted. Said gasket (14) has both a sealing function to prevent dirt from penetrating into said seat, and a protection function of the side which in a preferred embodiment of this invention, is made of glass, and a clamping function of the side itself.

The blocking of the sides, as it will be better disclosed in the following of the present description, occurs by means of screws, bushings and sleeves.

The upper front crosspiece (29) allows to connect frontally and on the upper part all the sides and on it holes are furthermore arranged for the successive fixing of an upper top, not represented, by means of screws.

FIGS. 7, 8, and 9 illustrate the central side (34) and the lateral side (33).

Said lateral sides (33) have an essentially rectangular shape in which:

- the rear lower edge is removed obtaining a rectangular shaped recess intended to allow the insertion of said lateral side (33) into the seat (35) of said lower side section (15) without any interference with said lower rear section (12);
- the front lower edge is removed obtaining a rectangular shaped recess intended to allow the insertion of said lateral side (33) into the seat (35) of said lower side section (15) without any interference with said lower front section (11);
- the front upper edge is removed obtaining a rectangular shaped recess intended to allow the insertion of said lateral side (33) into the seat (35) of said upper side crosspiece (31) without any interference with said upper front crosspiece (29).

Said central sides (34) have an essentially rectangular shape in which:

- the rear lower edge is removed obtaining a rectangular shaped recess intended to allow the insertion of said central side (34) into the seat (35) of said lower central section (16) without any interference with said lower rear section (12);
- the front lower edge is removed obtaining a rectangular shaped recess intended to allow the insertion of said central side (34) into the seat (35) of said lower central section (16) without any interference with said lower front section (11);
- the front upper edge is removed obtaining a rectangular shaped recess intended to allow the insertion of said central side (34) into the seat (35) of said upper central crosspiece (32) without any interference with said upper front crosspiece (29);
- the rear upper edge is removed obtaining a rectangular shaped recess intended to facilitate the insertion of said central side (34) into the seat (35) of said central stanchion (24).

On said lateral (33) and central (34) sides (see FIG. 9) holes (26) are obtained for the insertion of bushings (27) intended to fix, by means of screws (5), some spacers (9) on which fixing devices (7) will be successively fixed for the fixing of accessories (6), such as drawers and/or extractable baskets, shelves, doors and other components whose possible installation will be evident to those skilled in the art and which have been schematically represented only in FIG. 1 in order not to complicate the successive representations.

Said sides are preferably made of glass and are structural elements because the weight of drawers, baskets and wing doors bears on them, by means of the spacers (9).

Said spacers (9) besides contributing to the load distribution of the weight of the accessories (6) on the sides (33, 34) and facilitating the assembly, also have the purpose of compensating the thickness difference between the standard sides made of any common material (usually having a thickness of 18 mm) and the sides made of glass (usually having a thickness of 10 mm). In this way, all the standard sized drawers, baskets and wing doors can be applied to the system.

Each side is fixed to the frames by means of insertion into the seats which are present on the various frames and previously described and by means of three screws only.

In the case of the lateral sides the fixing to the frame occurs on the lower side to the lower side sections (15) by means of two passing through screws which are screwed on corresponding bushings (27) inserted in proper holes (26) obtained on said sides.

In the case of the central sides the fixing to the frame occurs on the lower side to the lower central sections (16) by means of two passing through screws which are screwed on corresponding bushings (27) inserted in proper holes (26) obtained on said sides.

The upper fixing of said lateral (33) and central (34) sides made of glass has been made in such a way that the structure of the glass side is not weakened and that no breaking zones of the material are created. This has been obtained by means of an upper hole (25) located near the top edge of said sides, said hole being circularly shaped and open on the upper part by means of a notch which puts in communication the internal part of said upper hole with the top edge of said side. Said upper hole (25) being intended to house an upper bushing (28) with a cylindrical shape with a threaded hole radially located with respect to said cylinder. The fixing to said upper central crosspiece (32) of said upper frame (4) occurs by means of a screw which is screwed within said threaded hole radially located with respect to said upper bushing (28).

The assembly of said piece of furniture (1) occurs in the following way:

- the lower frame (2) is assembled as previously described, located in the desired location and put on a level condition by means of the feet (13);
- the rear frame (3), without the back (20), is fixed to the lower frame (2) by means of the screws;
- the rear frame (3) is fixed to the wall by means of safety squares;
- the back (20) is inserted into the proper seats which are present on the side stanchions (23) and on the central stanchions (24) and it is fixed on the upper part by means of the removable crosspiece (19);

the lateral (33) and central (34) sides are inserted into the proper seats which are present on said lower (2) and rear (3) frame and fixed by means of bushings (27) and screws (5), as previously described;

the upper frame (4) is fixed to the rear frame (3) by means of the screws which penetrate into seats arranged on the side (23) and central (24) stanchions of said rear frame (3);

the lateral (33) and central (34) sides are fixed to said upper frame (4) by means of bushings (28) and screws (5), as previously described;

the bottom (8) is laid on said lower frame (2);

the accessories (6) are fixed by means of the fixing devices (7) applied on the spacers (9).

Finally the end portions of said lower (2), rear (3) and upper (4) frames which are visible, are hidden and protected by the front cover (10), by the lower frame covers (18), by the upper frame covers (30).

In the preferred embodiment of this invention, said piece of furniture (1) only consists of recyclable materials and, by way of example only, said materials can be:

Glass for lateral (33) and central (34) sides, bottoms (8), back (20)

Aluminium for the front cover (10) and for the lower (2), rear (3) and upper (4) frames A laminated material for the back (20), which can be possibly made of glass Megol for the gaskets (14)

ABS for the lower frame covers (18), upper frame covers (30) and for the front cover (10) which can be possibly made of aluminium Steel for the tie-rods (17) and the screws (5)

Acetal resin for the bushings (27, 28).

At the end of the life cycle the piece of furniture (1) can be easily and completely dismounted because the assembly comprises only mechanical junctions.

The system is sent in a dismounted condition reducing the encumbrance in the transportation phase and giving the user the possibility to assemble it by himself.

All the standard sized drawers, baskets and wing doors can be applied to the system.

Frontally one can only see, on the side, the border of the glass, on the bottom, the glass bottom and, on the back made of a laminated material, only one aluminium section.

As previously disclosed, the lower side of the piece of furniture (1) and more in detail of the lower frame (2) is easily inspectable for cleaning operations by removing the bottom (8) which advantageously rests on said lower frame (2) without being fixed to it.

The description of this invention has been made with reference to the enclosed figures showing a preferred embodiment of the invention itself, but it is evident that many possible alterations, modifications and variations will be immediately apparent to those skilled in the art in light of the foregoing description. Thus, it should be understood that the invention is not limited by the foregoing description, but embraces all such alterations, modifications and variations in accordance with the spirit and scope of the appended claims.

What is claimed is:

1. An article of furniture of the type provided with compartments housing accessories, in which said article of furniture comprises a lower frame, a rear frame, an upper frame, and lateral sides, and characterised in that:

said lower frame comprises a lower front section and a lower rear section connected to each other using lower side sections orthogonally and internally placed with respect to said lower front section and said lower rear section and fixed using at least a first fixing means;

said rear frame comprises an upper rear crosspiece and a lower rear crosspiece connected to each other using side stanchions orthogonally and internally placed with respect to said upper rear crosspiece and said lower rear crosspiece and fixed using at least a second fixing means;

said upper frame comprises an upper front crosspiece on which upper side crosspieces are fixed using at least a third fixing means, said lower side sections and said side stanchions and said upper side crosspieces including seats wherein said lateral sides are inserted into said seats, said lateral sides being fixed on the lower side using at least a fourth fixing means inserted in holes obtained on the lower side of said lateral sides and by means of at least a fifth fixing means which fix said lateral sides on said lower side sections;

said lateral sides being also fixed on the upper part by means of at least a sixth fixing means inserted in an upper hole obtained on said lateral sides and using at least a seventh fixing means which fix said lateral sides on said upper side crosspieces and further characterised in that said lateral sides have an essentially rectangular shape in which:

the rear lower edge is removed obtaining a rectangular shaped recess which allows the insertion of said lateral side into the seat of said lower side section;

the front lower edge is removed obtaining a rectangular shaped recess which allows the insertion of said lateral side into the seat of said lower side section;

the front upper edge is removed obtaining a rectangular shaped recess which allows the insertion of said lateral side into the seat of said upper side crosspiece.

2. The article of furniture according to claim 1 characterised in that:

said lower frame also includes at least one lower central section placed parallel to said lower side sections and internally placed with respect to said lower side sections and orthogonally and internally placed with respect to said lower front and lower rear sections and fixed using at least one fixing means, said at least one lower central sections including seats wherein central sides are inserted into said seats;

said rear frame also includes at least one central stanchion placed parallel to said side stanchions and internally placed with respect to said side stanchions and orthogonally and internally placed with respect to said upper rear and lower rear crosspieces and fixed using at least one fixing means, said central stanchions including seats intended to house by means of insertion said central sides;

said upper frame also includes at least one upper central crosspiece placed parallel to said upper side crosspieces and internally placed with respect to said upper side crosspieces and orthogonally placed with respect to said upper front crosspiece and fixed using at least one fixing means, said at least one upper central crosspieces including seats intended to house by means of insertion said central sides;

said central sides being fixed on the lower side using at least one fixing means inserted in holes obtained on the lower side of said central sides and at least one fixing means which fix said central sides on said lower central sections, said central sides being fixed on the upper part using at least one fixing means inserted in an upper hole obtained on said central sides and at least one fixing means which fix said central sides on said upper central crosspieces.

3. The article of furniture according to claim 2 characterised in that each of said at least one upper holes obtained on said sides is located near the top edge of said sides and is circularly shaped and open on the upper part by means of a notch which puts in communication the internal part of said upper hole with the top edge of said side, said at least one upper holes each being intended to house a fixing means having a cylindrical shape with a threaded hole radially located with respect to said cylinder in an intermediate position with respect to the height of the cylinder itself, said hole being intended to house a fixing means which fixes said sides to said upper central crosspiece of said upper frame.

4. The article of furniture according to claim 2 characterised in that said central sides have an essentially rectangular shape in which:

the rear lower edge is removed obtaining a rectangular shaped recess allowing the insertion of said central side into the seat of said lower central section;

the front lower edge is removed obtaining a rectangular shaped recess allowing the insertion of said central side into the seat of said lower central section;

the front upper edge is removed obtaining a rectangular shaped recess allowing the insertion of said central side into the seat of said upper central crosspiece;

the rear upper edge is removed obtaining a rectangular shaped recess facilitating the insertion of said central side into the seat of said central stanchion.

5. The article of furniture according to claim 2 characterised in that said side stanchions and said central stanchions of said rear frame form a guide for the insertion from above of at least one back intended to close said article of furniture on the rear side fixed to said rear frame by means of removable crosspieces.

6. The article of furniture according to claim 5 characterised in that said lower frame, rear frame, upper frame, lateral sides, and first fixing means fixing comprise recyclable materials.

7. The article of furniture according to claim 5 characterised in that said backs are made of glass.

8. The article of furniture according to claim 5 characterised in that said backs are made of a laminated material.

9. The article of furniture according to claim 1 characterised in that said seats for the insertion of said sides include gaskets along at least part of the corresponding side of said sides.

10. The article of furniture according to claim 1 characterised in that said lower frame is covered on the upper part by means of removable bottoms.

11. The article of furniture according to claim 10 characterised in that said bottoms are made of glass.

12. The article of furniture according to claim 10 characterised in that said bottoms are made of a laminated material.

13. The article of furniture according to claim 1 characterised in that said first fixing means comprises tie-rods.

14. The article of furniture according to claim 1 characterised in that said lower frame includes ground supporting means, said ground supporting means being adjustable and inserted and fixed in position on seats obtained near the ends of said lower front section and lower rear section.

15. The article of furniture according to claim 1 characterised in that said sides include at least one supporting means of the accessories, said supporting means being fixed to the sides using at least one fixing means inserted in holes obtained on said sides and using at least one fixing means which fix said means on said sides.

16. The article of furniture according to claim 1 characterised in that said sides are made of glass.

17. The article of furniture according to claim 1 characterised in that said lower, rear and upper frames are made of aluminium.

18. The article of furniture according to claim 1 characterised in that it includes shelves inside the compartments, extractable drawers, extractable baskets, closing doors of the compartments, and an upper cover top.

19. The article of furniture according to claim 1 wherein the first fixing means comprises screws and/or bushings.

* * * * *